US011839300B1

(12) United States Patent
Li

(10) Patent No.: US 11,839,300 B1
(45) Date of Patent: Dec. 12, 2023

(54) MOUNTING STRUCTURE OF A DRAWER

(71) Applicant: LUOYANG DBIN OFFICE FURNITURE CO., LTD., Luoyang (CN)

(72) Inventor: Yingbin Li, Luoyang (CN)

(73) Assignee: LUOYANG DBIN OFFICE FURNITURE CO., LTD., Luoyang (CN)

( * ) Notice: Subject to any disclaimer, the term of this patent is extended or adjusted under 35 U.S.C. 154(b) by 0 days.

(21) Appl. No.: 17/978,221

(22) Filed: Nov. 1, 2022

(51) Int. Cl.
*A47B 88/427* (2017.01)

(52) U.S. Cl.
CPC ..... *A47B 88/427* (2017.01)

(58) Field of Classification Search
CPC ..... A47B 88/43; A47B 88/427; A47B 2088/4235; A47B 2088/4272; A47B 2088/4278; A47B 2210/09; A47B 2210/091; A47B 2210/095; A47B 2210/097; A47B 2210/098
See application file for complete search history.

(56) References Cited

U.S. PATENT DOCUMENTS 2,686,704 A * 8/1954 Wolters ..... A47B 47/03 312/257.1
2,815,649 A * 12/1957 Di Angelus ..... F25D 25/02 312/351
3,771,849 A * 11/1973 Barber ..... A47B 88/43 312/350
4,838,627 A * 6/1989 Macias ..... A47B 88/43 312/334.7
5,378,057 A * 1/1995 Bach ..... A47B 55/00 312/334.4
5,624,171 A * 4/1997 Soja ..... A47B 88/487 312/334.44
5,775,786 A * 7/1998 Liebertz ..... A47B 88/43 312/351
5,785,401 A * 7/1998 Bowyer ..... A47B 88/43 312/334.7
5,927,838 A * 7/1999 Hellman, Jr. ..... F16B 12/38 312/263
5,927,839 A * 7/1999 Alfaro ..... A47B 88/994 312/301

(Continued)

FOREIGN PATENT DOCUMENTS

CA 2178446 A1 * 12/1996
CA 2258635 C * 12/2002 ..... A47B 88/43

(Continued)

*Primary Examiner* — Hanh V Tran

(57) ABSTRACT

The present disclosure provides mounting structure of a drawer, configured to mount the drawer to a furniture by at least one sliding rail structure, the sliding rail structure includes a first sliding rail and a movable member, wherein the mounting structure includes: at least one first connecting element, arranged on the movable member, the first connecting element is detachably connected with the drawer; and at least one second connecting element, arranged on the first sliding rail, the second connecting element is detachably connected with a side wall of the furniture, the movable member is slidably connected with the first sliding rail to slidably connect the drawer with the cabinet body.. The present disclosure further provides a method for mounting a drawer to a furniture by at least one sliding rail structure.

15 Claims, 19 Drawing Sheets

(56) References Cited

U.S. PATENT DOCUMENTS

| | | | | | |
|---|---|---|---|---|---|
| 6,076,908 | A * | 6/2000 | Maffeo | A47B 88/427 | 248/222.51 |
| 6,123,402 | A * | 9/2000 | Bowyer | A47B 88/43 | 312/334.7 |
| 6,209,979 | B1 * | 4/2001 | Fall | H05K 7/1489 | 312/319.1 |
| 7,481,503 | B2 * | 1/2009 | Youngs | A47B 47/0066 | 312/217 |
| 7,722,139 | B1 * | 5/2010 | Chen | A47B 88/427 | 312/334.7 |
| 8,740,319 | B1 * | 6/2014 | Davis | E05B 67/383 | 312/216 |
| 11,377,878 | B1 * | 7/2022 | Cheung | A47B 88/50 | |
| 11,549,286 | B1 * | 1/2023 | Chen | E05B 65/463 | |
| 2003/0111941 | A1 * | 6/2003 | Noel | A47B 91/005 | 312/334.4 |
| 2018/0066454 | A1 * | 3/2018 | Lu | A47B 67/04 | |
| 2020/0367648 | A1 * | 11/2020 | Ciampi | F24C 15/168 | |

FOREIGN PATENT DOCUMENTS

| | | | | | |
|---|---|---|---|---|---|
| CH | 687844 | A5 * | 3/1997 | A47B 88/0422 | |
| CN | 101596045 | A * | 12/2009 | A47B 88/0422 | |
| DE | 3103281 | A1 * | 8/1982 | | |
| DE | 9113569 | U1 * | 2/1992 | | |
| DE | 202006011921 | U1 * | 11/2006 | A47B 88/0422 | |
| DE | 202009006699 | U1 * | 9/2009 | A47B 88/0422 | |
| DE | 202009011106 | U1 * | 3/2011 | A47B 88/40 | |
| DE | 102011051126 | A1 * | 12/2012 | A47B 88/40 | |
| DE | 202013101842 | U1 * | 7/2013 | A47B 88/0422 | |
| KR | 200393556 | Y1 * | 8/2005 | | |
| KR | 101828795 | B1 * | 3/2018 | | |
| KR | 102253663 | B1 * | 5/2021 | | |
| WO | WO-9847410 | A1 * | 10/1998 | A47B 88/427 | |

* cited by examiner

MOUNTING STRUCTURE OF A DRAWER

FIELD

The present disclosure relates to the technical field of cabinets, specifically to a mounting structure of a drawer, and a method for mounting a drawer on a furniture by at least one sliding rail structure.

BACKGROUND

The existing cabinet normally includes a cabinet body, at least one drawer, and at least one sliding rail structure, the sliding rail structure includes a sliding rail and a movable member slidably connected with the sliding rail. When assembling the cabinet, the sliding rail is fixed to an inner side of the cabinet body by bolts, the movable member is fixed to an outer side of the drawer by bolts, then the movable member is slidably connected with the sliding rail to connect the drawer with the cabinet body. However, it is complicated to assemble the cabinet. Therefore, it is necessary to provide a new sliding rail structure to solve the above problem.

SUMMARY

In view of the above-mentioned defects of the existing art, the present disclosure provides a mounting structure of a drawer, and a method for mounting a drawer on a furniture by at least one sliding rail structure, the drawer can be mounted on the furniture conveniently.

To achieve the above purpose, the present disclosure provides a mounting structure of a drawer, configured to mount the drawer on a furniture by at least one sliding rail structure, the sliding rail structure includes a first sliding rail and a movable member, wherein the mounting structure includes: at least one first connecting element, arranged on the movable member, the first connecting element is detachably connected with the drawer; and at least one second connecting element, arranged on the first sliding rail, the second connecting element is detachably connected with a side wall of the furniture, the movable member is slidably connected with the first sliding rail to slidably connect the drawer with the cabinet body..

Furthermore, a quantity of the at least one first connecting element is more than one, and the first connecting elements are spaced apart from each other.

Furthermore, at least two of the first connecting elements are arranged towards different directions.

Furthermore, a quantity of the at least one second connecting element is more than one, and the second connecting elements are spaced apart from each other.

Furthermore, at least two of the second connecting elements are arranged towards different directions.

Furthermore, the mounting structure of the drawer further includes: at least one first through hole, defined in the first sliding rail, the second connecting element is configured to at least partially cover the first through hole; and/or at least one second through hole, defined in the movable member, the at least one first connecting element is configured to at least partially cover the second through hole.

Furthermore, the second connecting element is a protrusion, a clamp, an elastic sheet, a rigid sheet, a through hole, or a groove; and/or the first connecting element is a protrusion, a clamp, an elastic sheet, a rigid sheet, a through hole, or a groove.

Furthermore, the mounting structure of the drawer further includes: at least one third connecting element, arranged on the first sliding rail, the third connecting element is detachably connected with the side wall of the furniture.

Furthermore, the third connecting element is spaced apart from the second connecting element; and/or the third connecting element is different from the second connecting element in shape; and/or the third connecting element is a protrusion, a clamp, an elastic sheet, a rigid sheet, a through hole, or a groove; and/or the third connecting element and the second connecting element are arranged on a same side of the first sliding rail; and/or free ends of the third connecting element and the second connecting element are extended in different directions; and/or the mounting structure further includes at least one third through hole defined in the first sliding rail, the at least one third connecting element is configured to at least partially cover the third through hole.

Furthermore, the mounting structure of the drawer further includes: at least one fourth connecting element, arranged on the movable member, the fourth connecting element is detachably connected with the drawer.

Furthermore, the fourth connecting element is spaced apart from the first connecting element; and/or the fourth connecting element is different from the first connecting element in shape; and/or the fourth connecting element is a protrusion, a clamp, an elastic sheet, a rigid sheet, a through hole, or a groove; and/or the fourth connecting element and the first connecting element are arranged on a same side of the movable member; and/or free ends of the fourth connecting element and the first connecting element are extended in different directions; and/or the mounting structure further includes at least one fourth through hole defined in the movable member, the at least one fourth connecting element is configured to at least partially cover the fourth through hole.

Furthermore, the mounting structure of the drawer further includes: at least one first mounting member, defined on the drawer, the first connecting element is detachably connected with the first mounting member; and at least one second mounting member, defined on the furniture, the second connecting element is detachably connected with the second mounting member.

Furthermore, the first mounting member is a protrusion, a clamp, an elastic sheet, a rigid sheet, a through hole, or a groove, and the first mounting member is matched with the first connecting element; and/or the second mounting member is a protrusion, a clamp, an elastic sheet, a rigid sheet, a through hole, or a groove, and the second mounting member is matched with the second connecting element.

Furthermore, the mounting structure of the drawer further includes: a first mounting assembly, arranged on the side wall of the furniture, the first mounting assembly includes the at least one second mounting member.

Furthermore, wherein the first mounting assembly further includes: a first mounting plate, including the at least one second mounting member; and at least one first connecting plate, connected with the side wall and the first mounting plate, the first mounting plate, the first connecting plate, and the side wall cooperatively define a first receiving space, the second connecting element is configured to pass through the second mounting member and partially extend in the first receiving space.

Furthermore, the mounting structure of the drawer further includes: a second mounting assembly, arranged on the side wall, the second mounting assembly includes at least one third mounting member, a quantity of the second connecting element is more than one, at least one of the second connecting elements is detachably connected with the third mounting member.

Furthermore, the second mounting assembly includes: a second mounting plate, including the at least one third mounting member; and at least one second connecting plate, connected with the side wall and the second mounting plate, the second mounting plate, the second connecting plate, and the side wall cooperatively define a second receiving space, at least one of the second connecting elements is configured to pass through the third mounting member and partially extend in the second receiving space.

Furthermore, the third mounting member is a protrusion, a clamp, an elastic sheet, a rigid sheet, a through hole, or a groove, and the third mounting member is matched with the second connecting element.

The present disclosure further provides a method for mounting a drawer to a furniture by at least one sliding rail structure, the drawer is provided with at least one first mounting member, a side wall of the furniture is provided with at least one second mounting member, the sliding rail structure includes a first sliding rail and a movable member slidably connected with the first sliding rail, the movable member is provided with at least one first connecting element, the first sliding rail is provided with at least one second connecting element, the method includes the following steps: connecting the first connecting element with the first mounting member, to connect the movable member with the drawer; and connecting the second connecting element with the second mounting member, to connect the first sliding rail with the cabinet body.

Furthermore, the second connecting element or the third connecting element is protrusion, a clamp, an elastic sheet, or a rigid sheet, the second mounting member is a through hole, a quantity of the second mounting member is more than one, the first connecting element or the fourth connecting element is protrusion, a clamp, an elastic sheet, or a rigid sheet, the first mounting member or the fourth mounting member is a through hole, wherein the method further includes: placing the second connecting element in the second mounting member; moving the second connecting element upwards to enable a third connecting element arranged on the first sliding rail to insert in the second mounting member; stopping moving the second connecting element upwards and the second connecting element moving downwards until the third connecting element is connected with or clamped with a lower periphery of the second mounting member; placing the first connecting element in the first mounting member; moving the first connecting element upwards to enable a fourth connecting element arranged on the movable member to insert in the fourth mounting member arranged on the drawer; and stopping moving the first connecting element upwards and the first connecting element moving downwards until the fourth connecting element is connected with or clamped with a lower periphery of the fourth mounting member;

In the technical solution of the present disclosure, the movable member is provided with at least one first connecting element, the first connecting element is detachably connected with the drawer, the first sliding rail is provided with at least one second connecting element, the second connecting element is detachably connected with the cabinet body. Through the first connecting element and the second connecting element, the movable member can be easily connected with the drawer, and the first sliding rail can be easily connected with the cabinet body, so the drawer can also be easily connected with the cabinet body.

BRIEF DESCRIPTION OF THE DRAWINGS

Implementations of the present disclosure will now be described, by way of embodiment, with reference to the attached FIG.s. It should be understood, the drawings are shown for illustrative purpose only, for ordinary person skilled in the art, other drawings obtained from these drawings without paying creative labor by an ordinary person skilled in the art should be within scope of the present disclosure.

Figure 1:
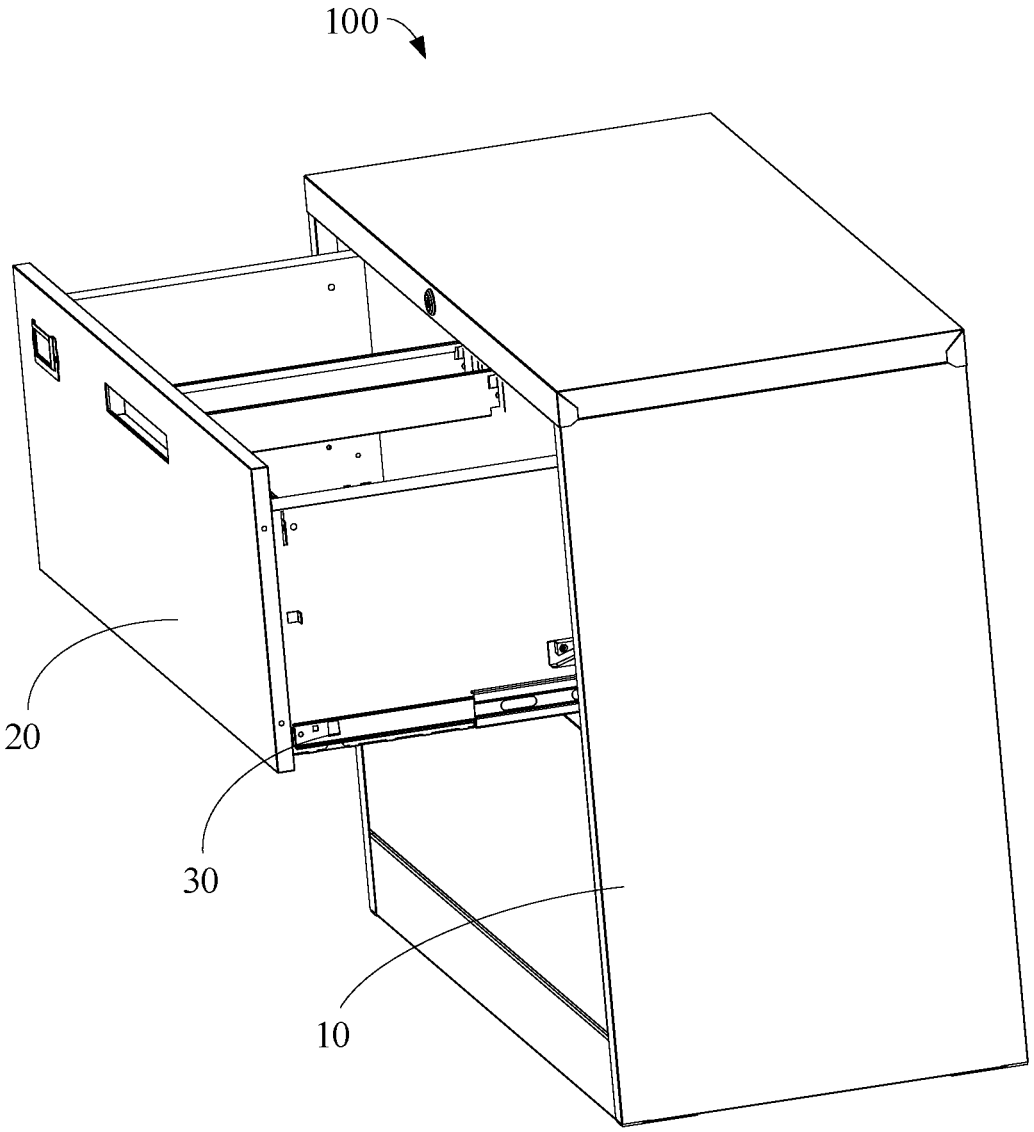
FIG. 1 is a structure diagram of a furniture according to an embodiment of the present disclosure.

The realization of the aim, functional characteristics, advantages of the present disclosure are further described specifically with reference to the accompanying drawings and embodiments.

DETAILED DESCRIPTION

It will be appreciated that for simplicity and clarity of illustration, where appropriate, reference numerals have been repeated among the different FIG.s to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion in the so-described combination, group, series, and the like. the present disclosure is illustrated by way of example and not by way of limitation in the FIG.s of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Figure 2:
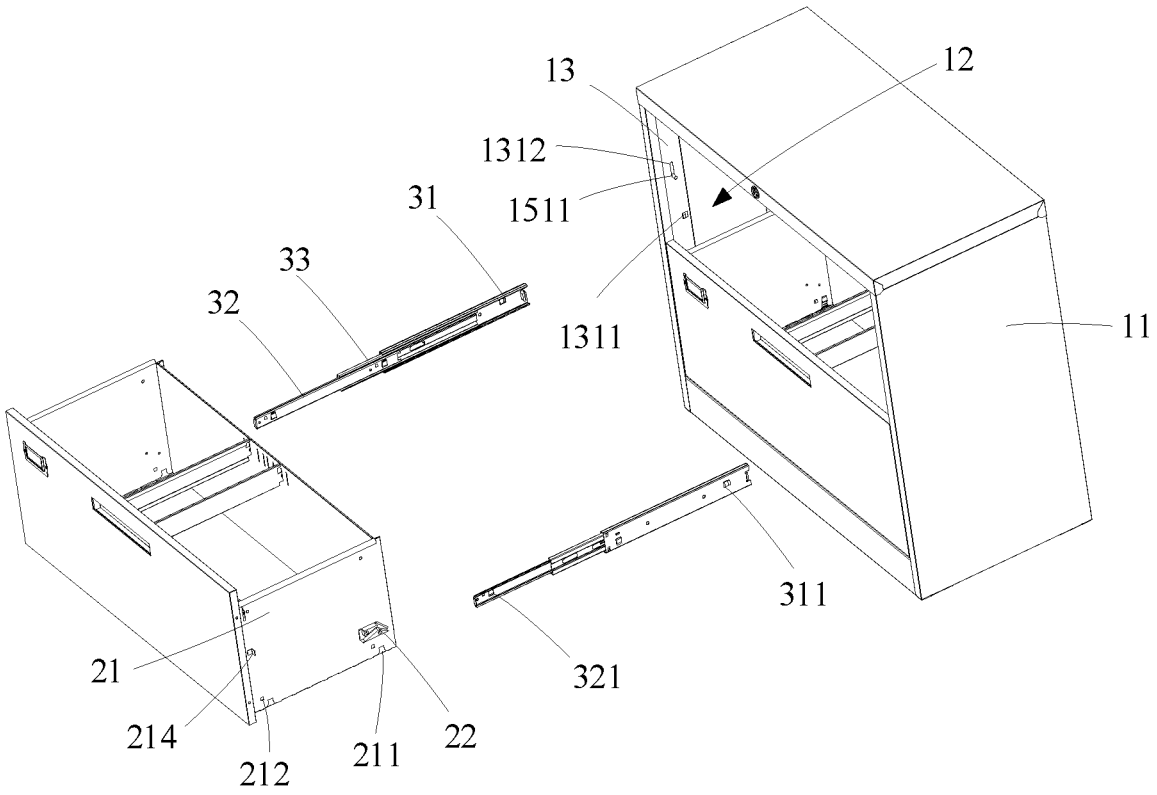
FIG. 2 is an exploded diagram of the furniture of FIG. 1.
Figure 3:
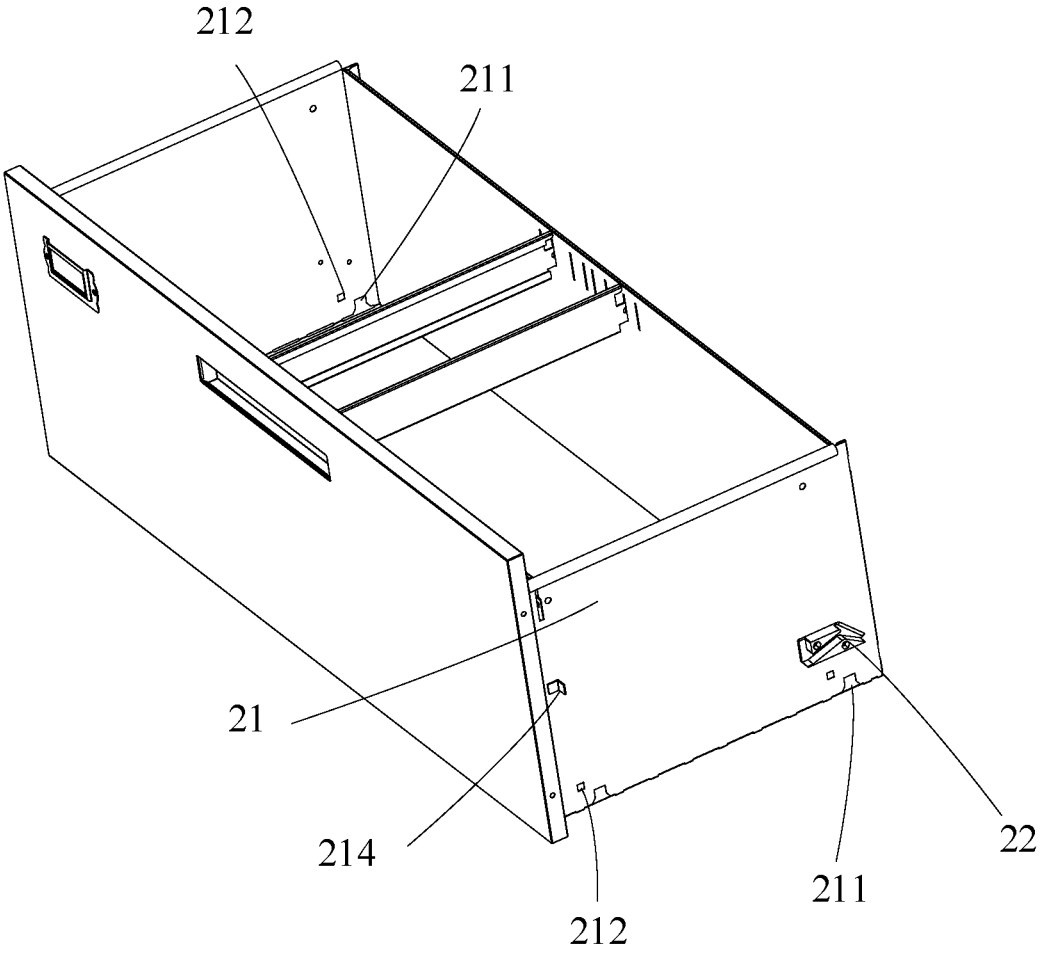
FIG. 3 is a structure diagram of a drawer as shown in FIG. 1.
Figure 4:
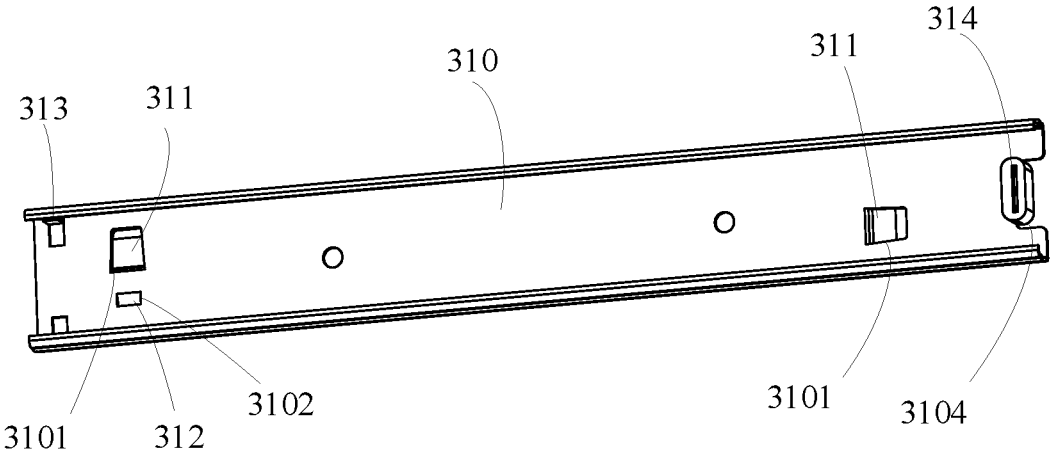
FIG. 4 is a structure diagram of a first sliding rail as shown in FIG. 1.
Figure 5:
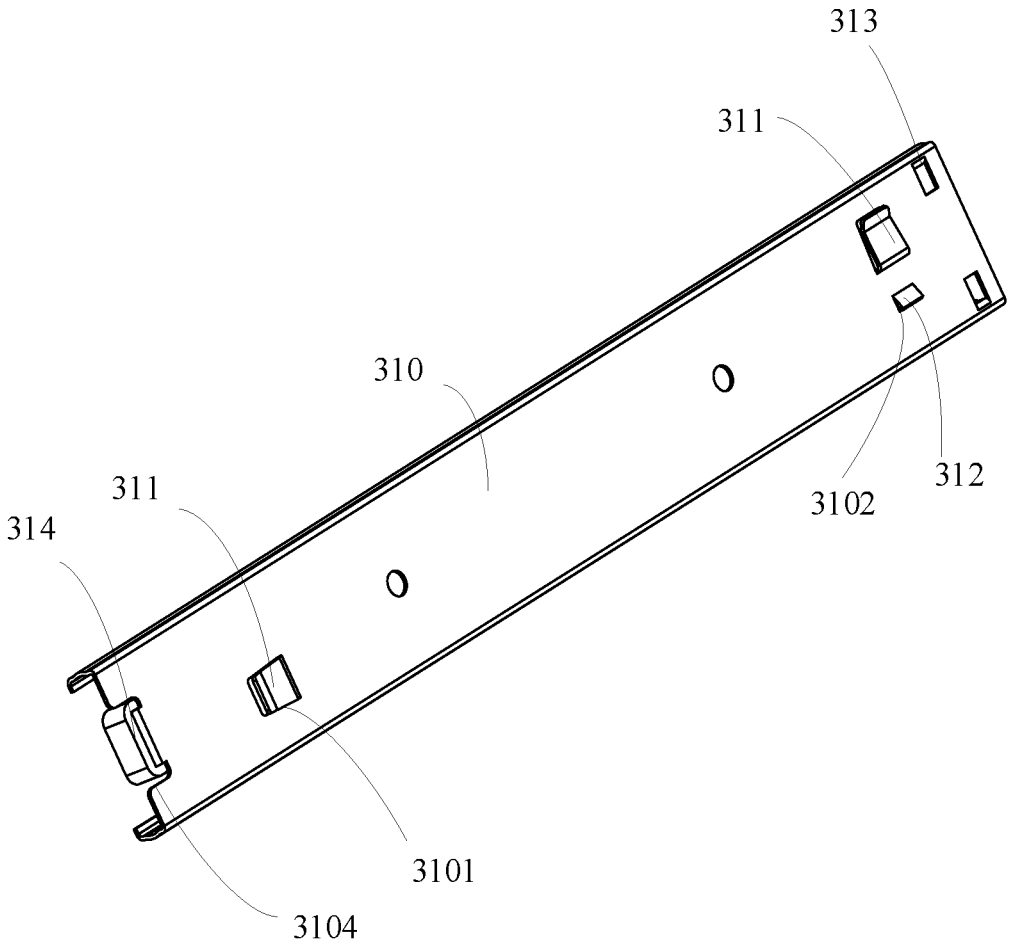
FIG. 5 is another structure diagram of the first sliding rail as shown in FIG. 1.
Figure 6:
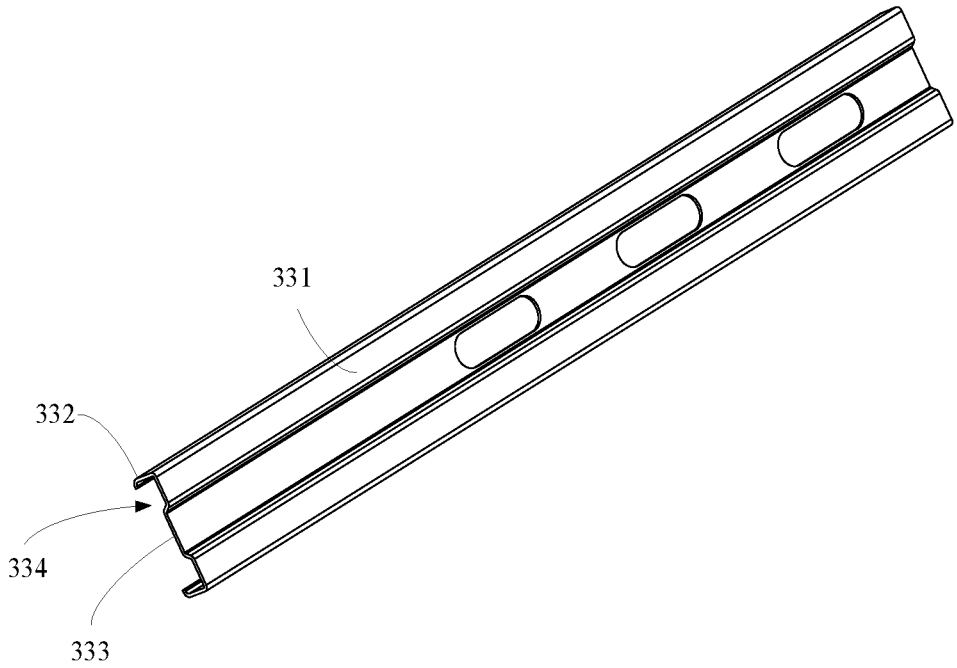
FIG. 6 is a structure diagram of a second sliding rail as shown in FIG. 1.
Figure 7:
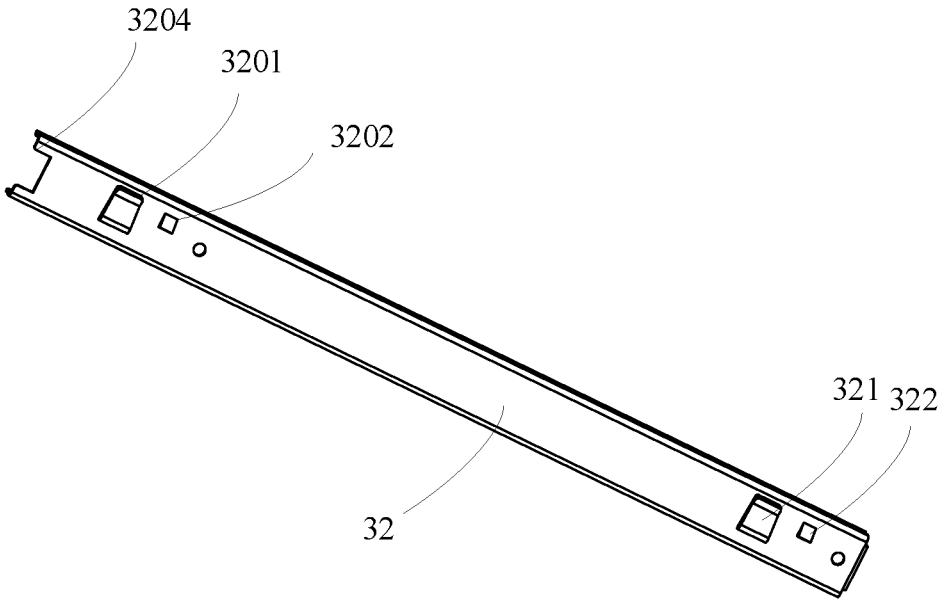
FIG. 7 is a structure diagram of a movable member as shown in FIG. 1.
Figure 8:
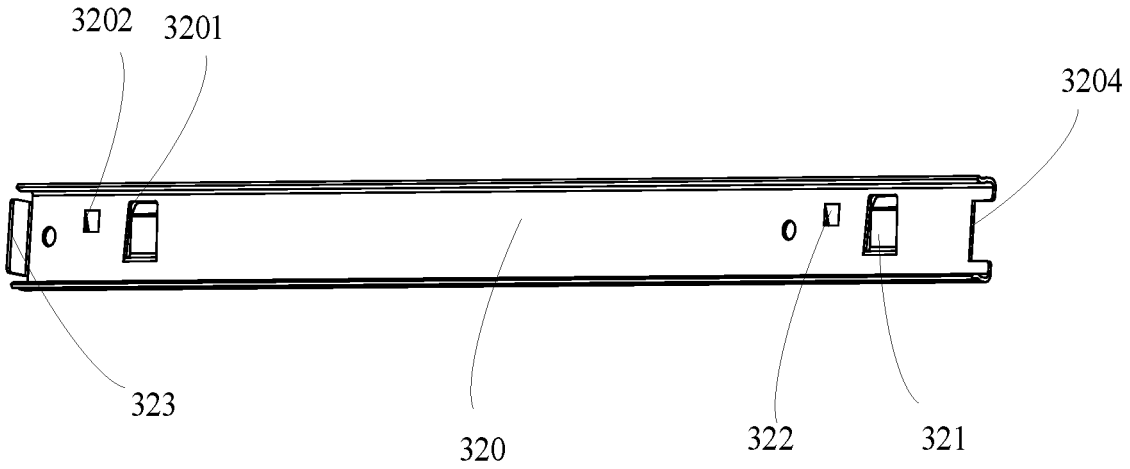
FIG. 8 is another structure diagram of the movable member as shown in FIG. 1.
Figure 9:
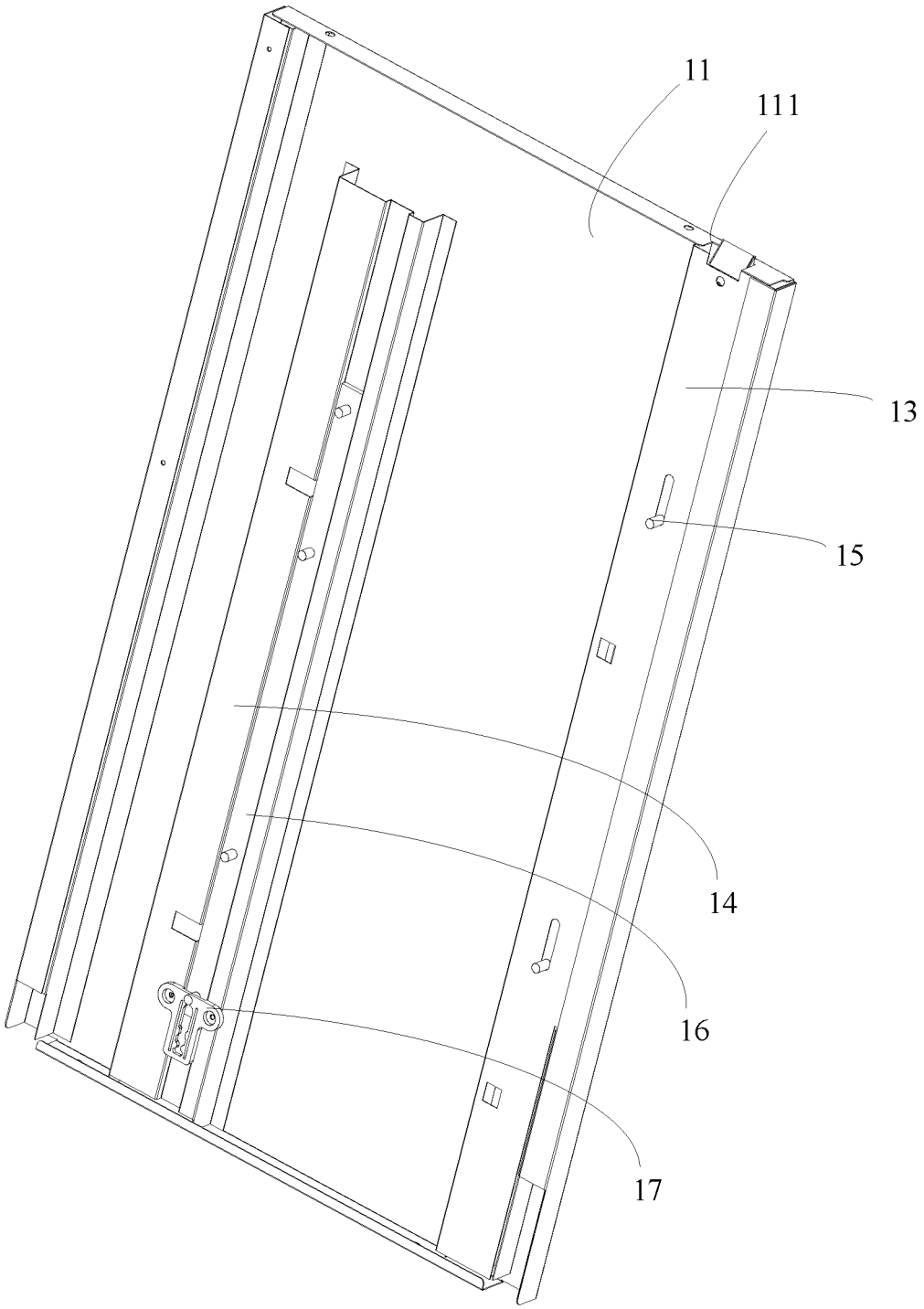
FIG. 9 is a structure diagram of a first side wall, a first mounting assembly, a second mounting assembly, a first locking member, a second locking member, and a first limiting member of the cabinet of FIG. 1.
Figure 10:
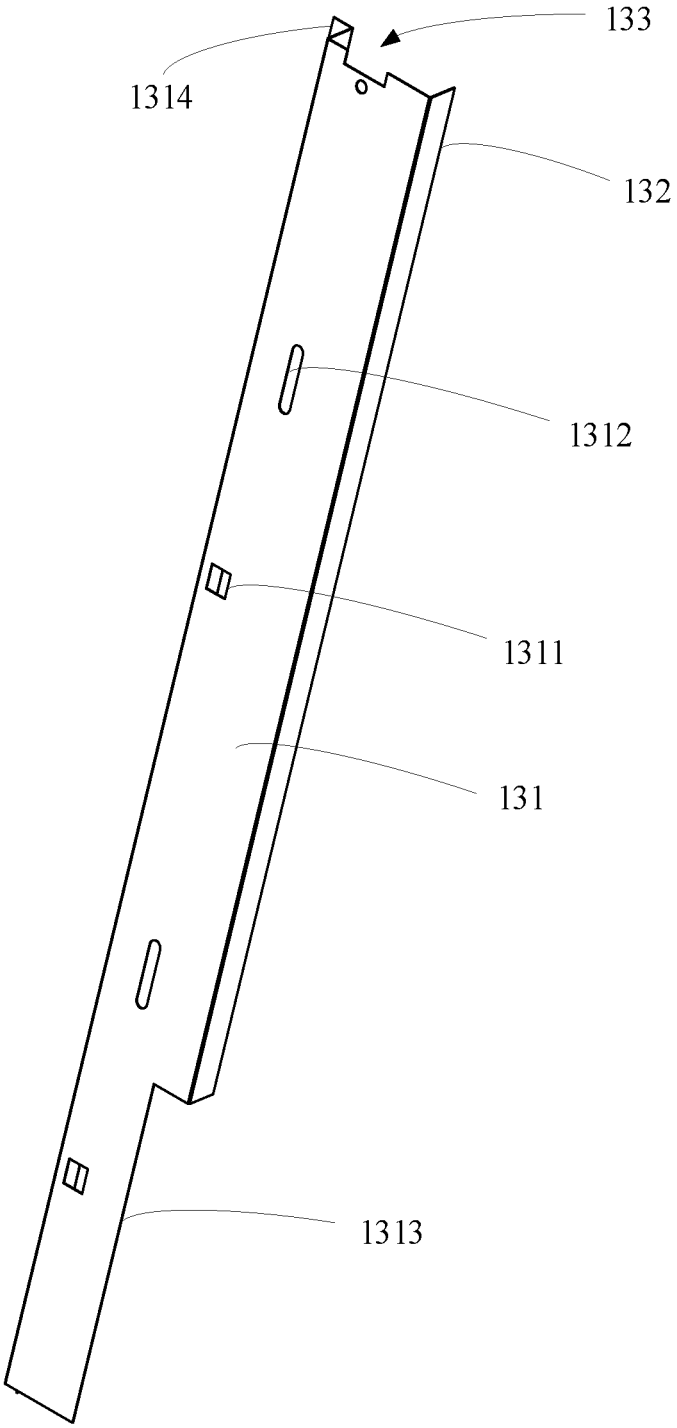
FIG. 10 is a structure diagram of the first mounting assembly as shown in FIG. 9.
Figure 11:
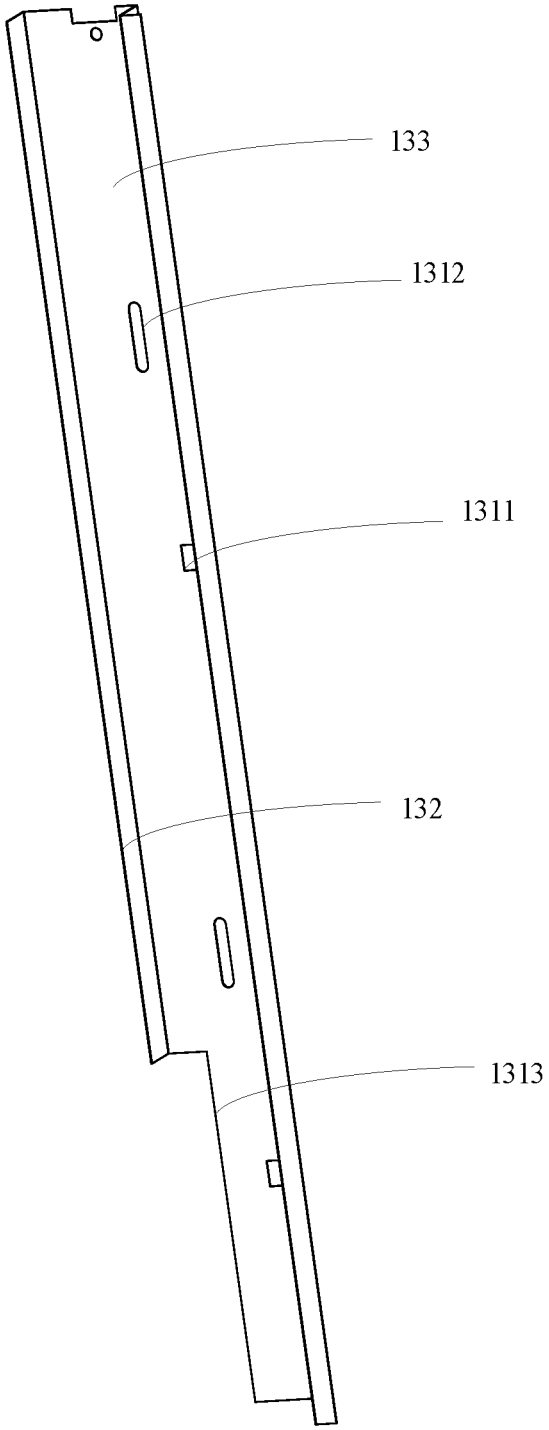
FIG. 11 is another structure diagram of the first mounting assembly as shown in FIG. 9.
Figure 12:
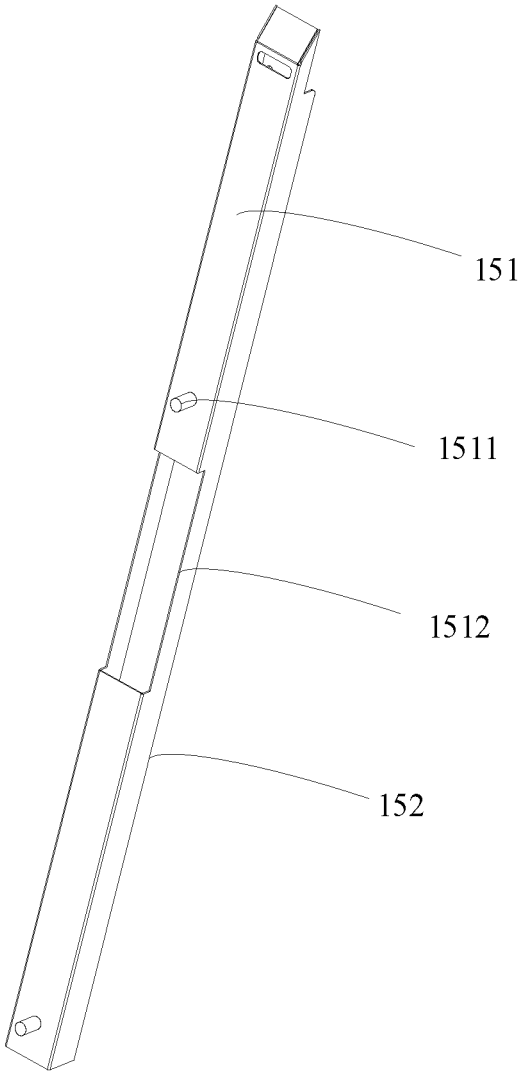
FIG. 12 is a structure diagram of the first locking member as shown in FIG. 9.
Figure 13:
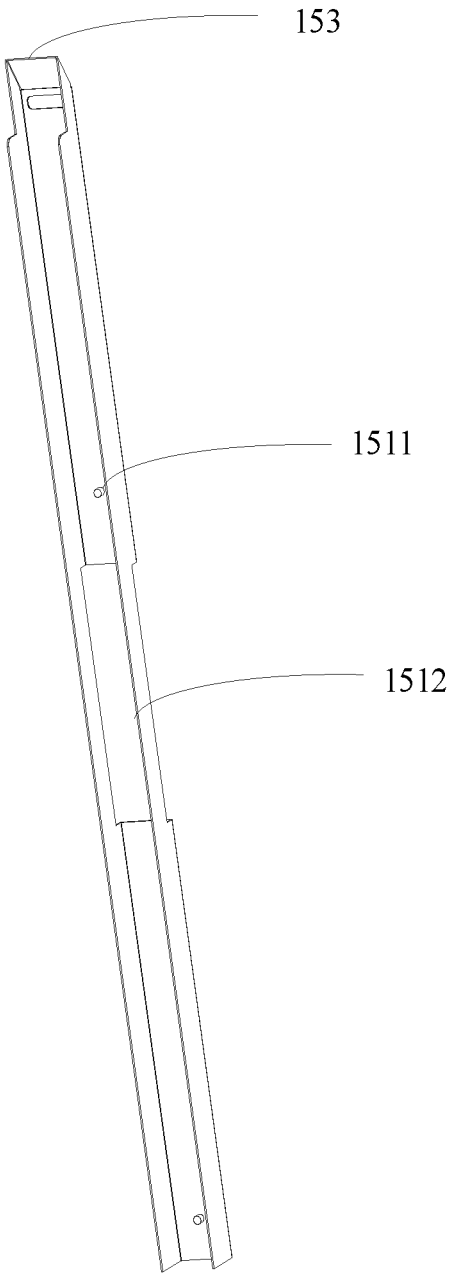
FIG. 13 is another structure diagram of the first locking member as shown in FIG. 9.
Figure 14:
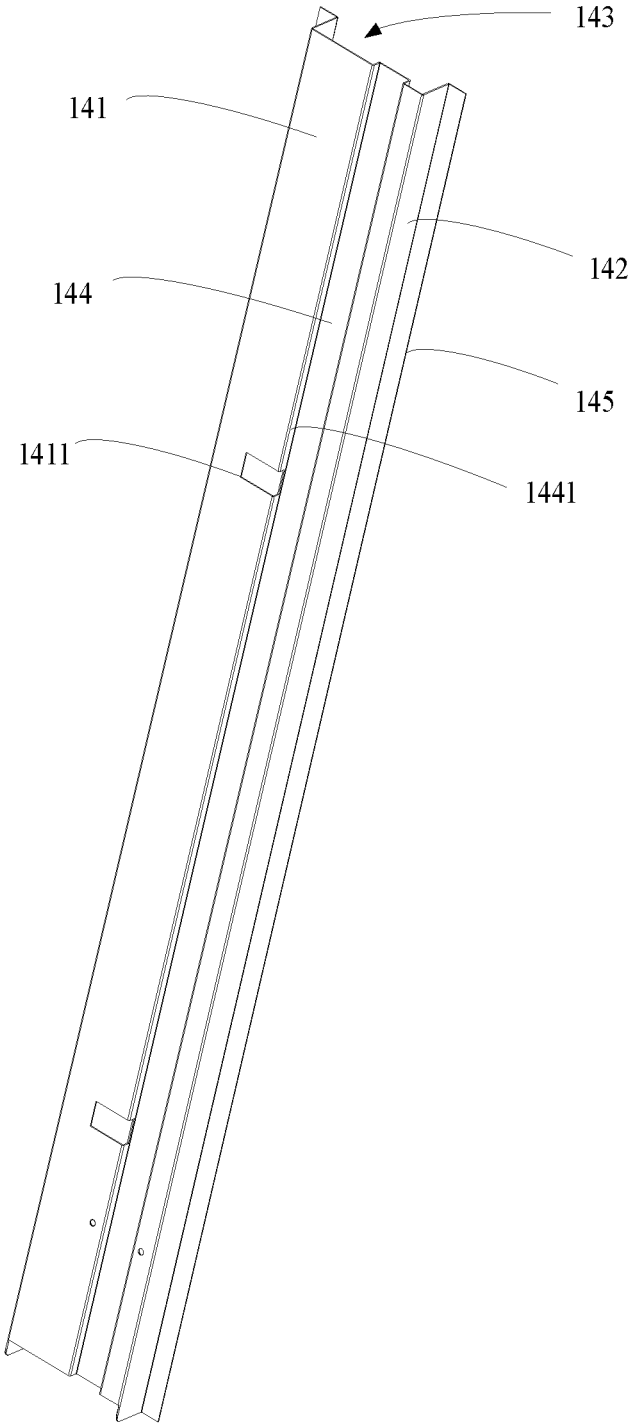
FIG. 14 is a structure diagram of the second mounting assembly as shown in FIG. 9.
Figure 15:
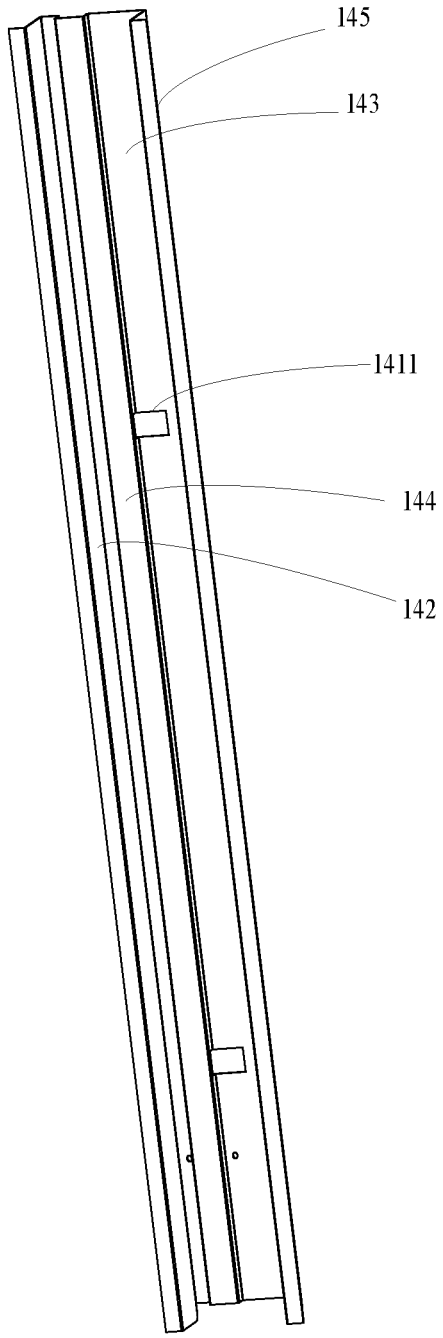
FIG. 15 is another structure diagram of the second mounting assembly as shown in FIG. 9.
Figure 16:
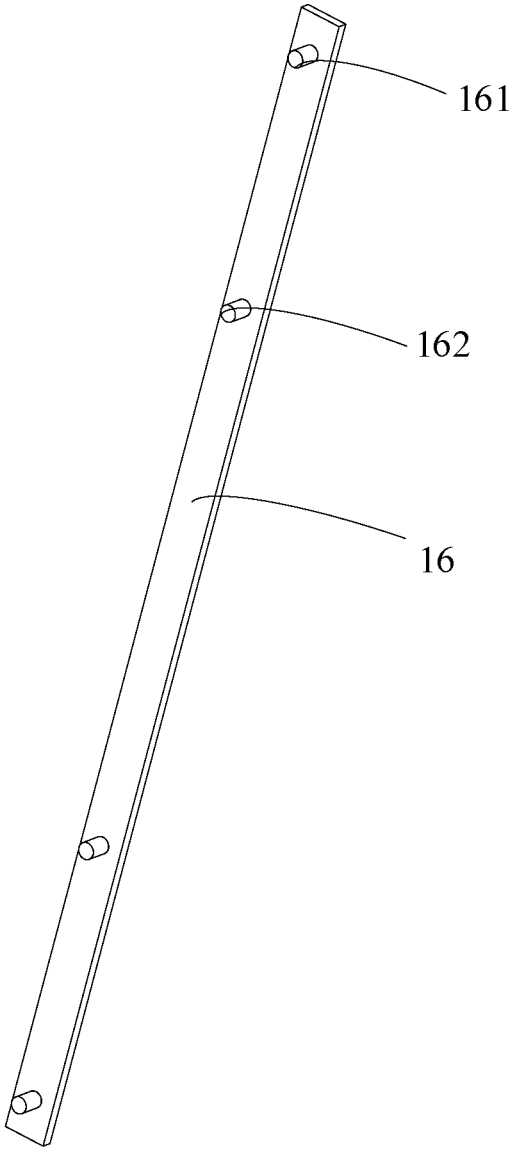
FIG. 16 is a structure diagram of the second locking member as shown in FIG. 9.
Figure 17:
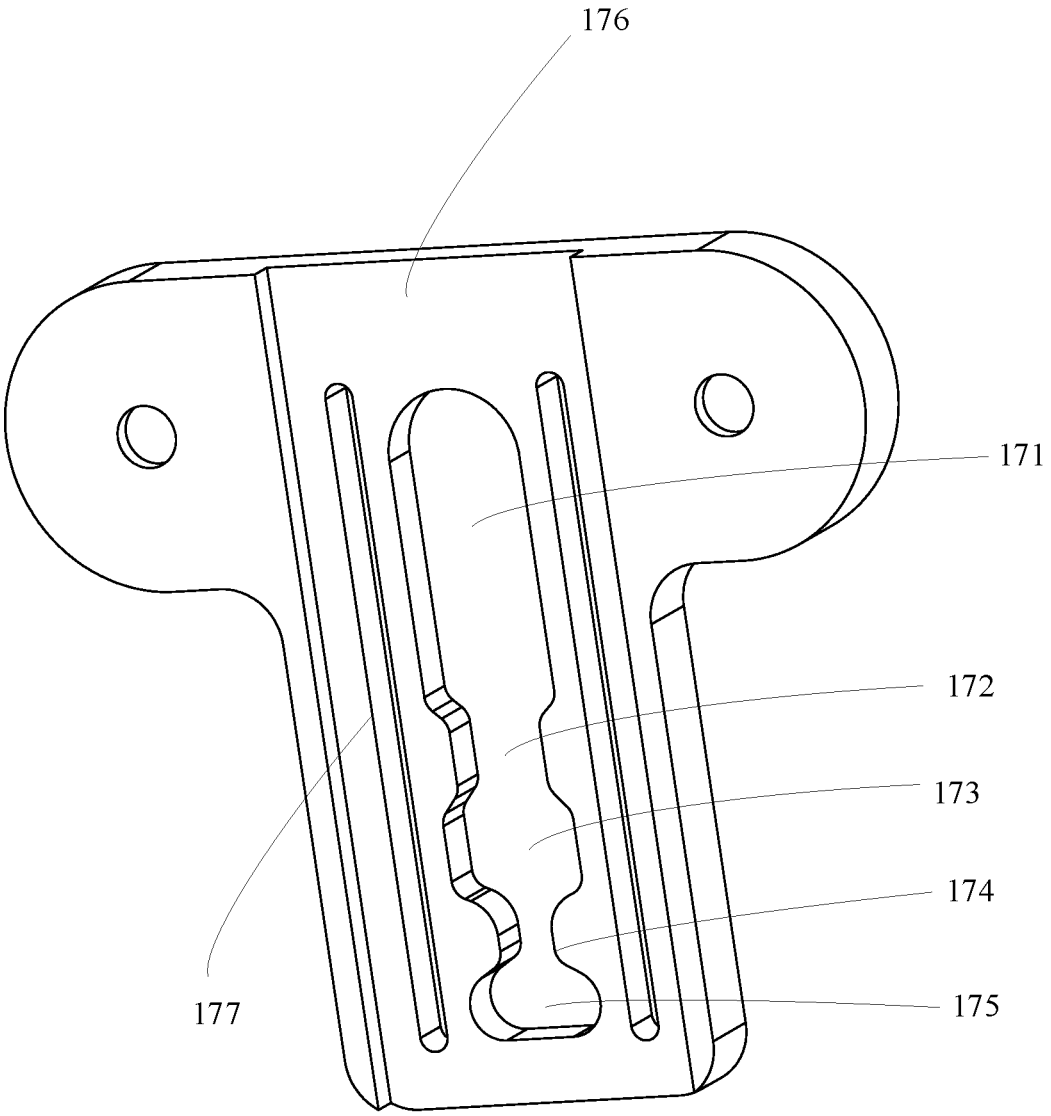
FIG. 17 is a structure diagram of the first limiting member as shown in FIG. 9.
Figure 18:
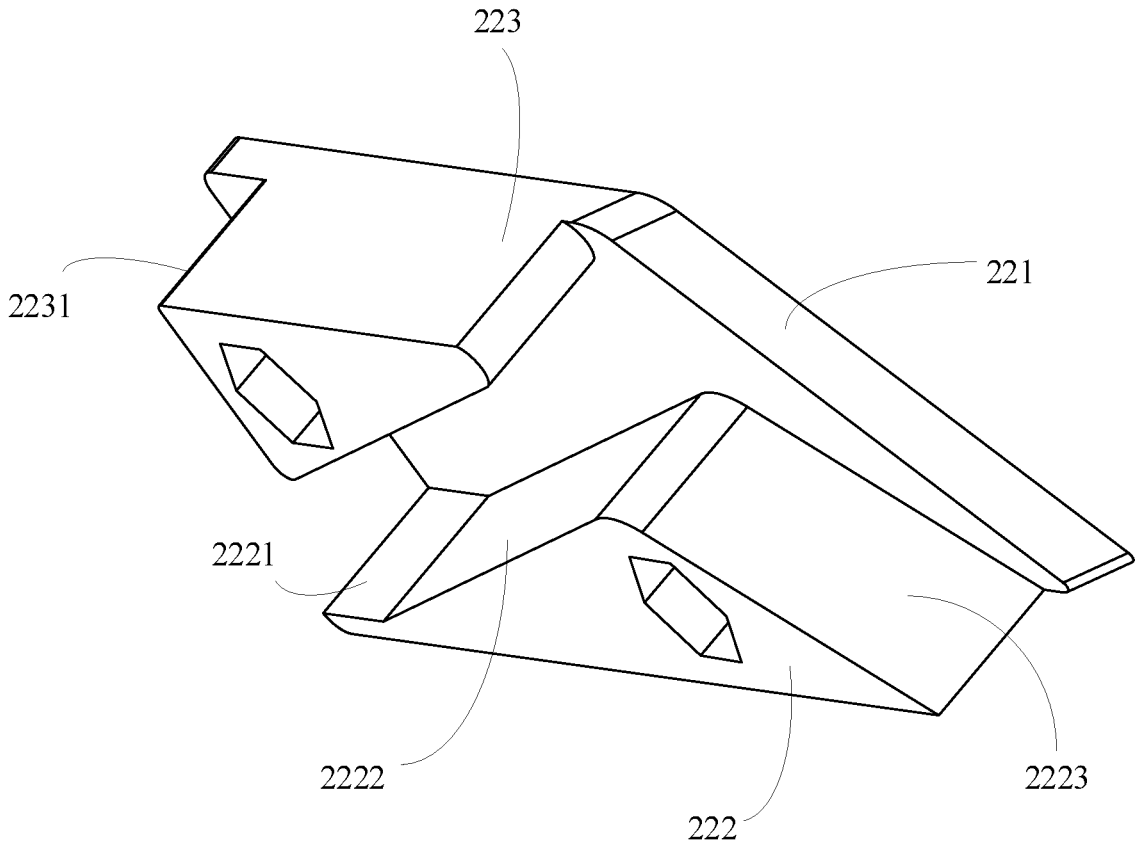
FIG. 18 is a structure diagram of the second limiting member as shown in FIG. 2.
Figure 19:
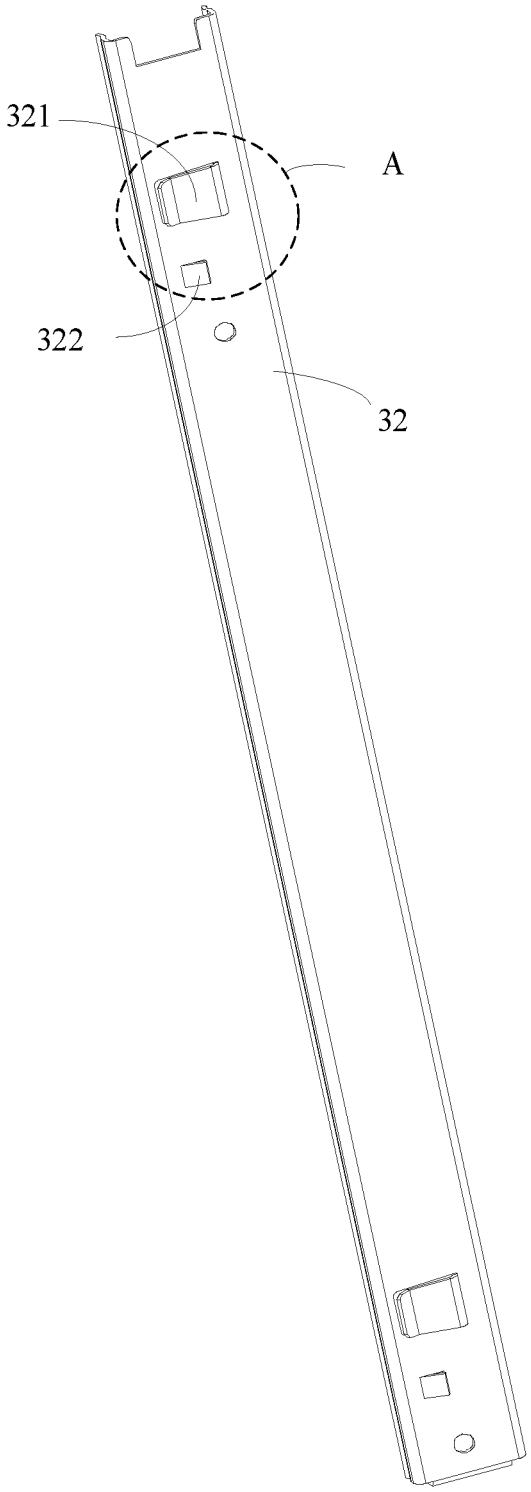
FIG. 19 is another structure diagram of the movable member as shown in FIG. 1.
Figure 20:
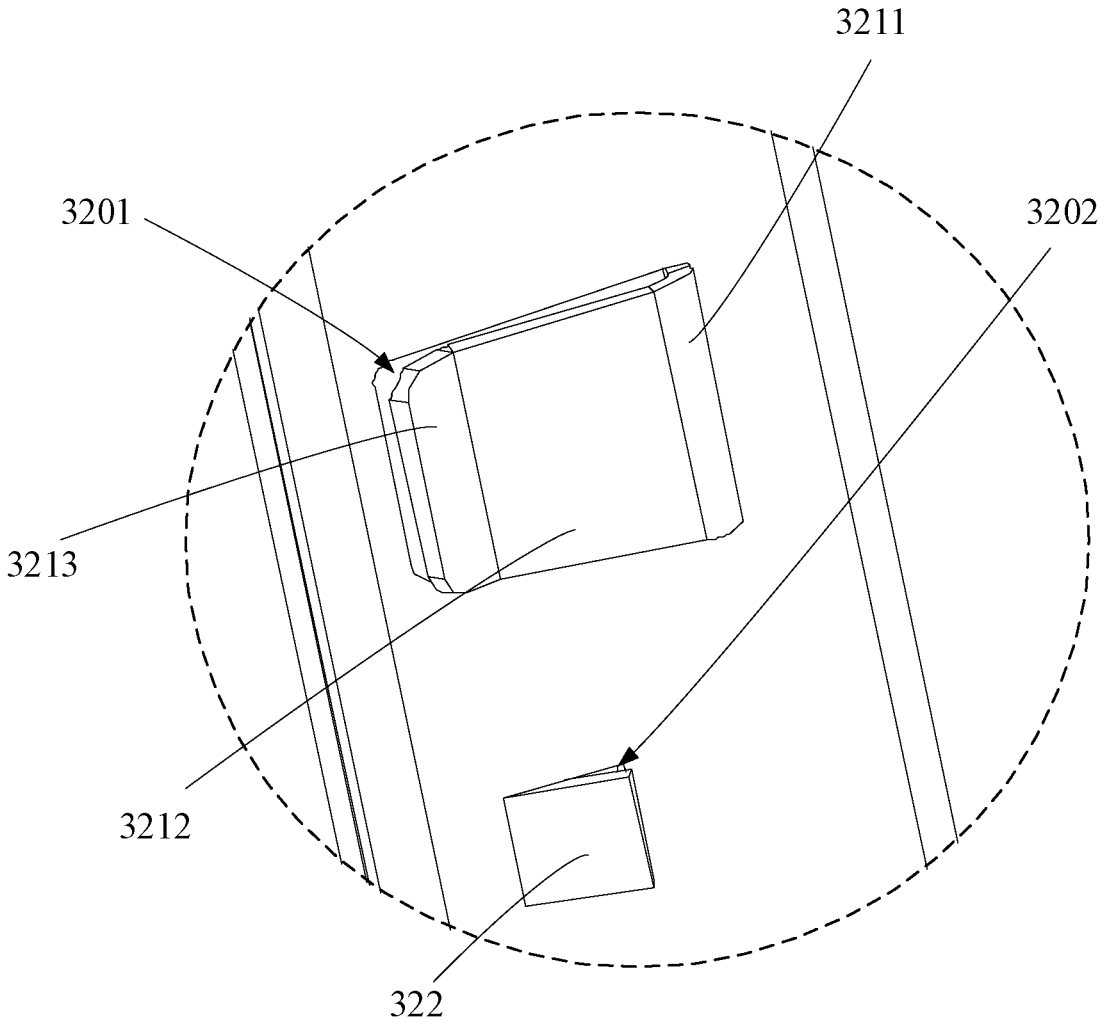
FIG. 20 is an exploded diagram of portion A as shown in FIG. 19.

Please referring to FIGS. 1 to 18, the present disclosure provides a mounting structure of a drawer, configured to mount the drawer 20 on a furniture by at least one sliding rail structure 30. The furniture may be a cabinet, a desk, a closet, a cupboard, a TV bench, and the like. The furniture of the present disclosure may be illustrated by a cabinet 100.

The cabinet 100 including a cabinet body 10 and at least one drawer 20. The sliding rail structure 30 is provided with a first sliding rail 31 and a movable member 32. The first sliding rail 31 is provided with at least one second connecting element 311 detachably connected with the cabinet body 10. The movable member 32 is provided with at least one first connecting element 321 detachably connected with the drawer 20, the movable member 32 is slidably connected with the first sliding rail 31 to slidably connect the drawer 20 with the cabinet body 10.

A quantity of the at least one second connecting element 311 is more than one, and the second connecting elements 311 are spaced apart from each other. At least two of the second connecting elements 311 are arranged towards different directions, so the first sliding rail 31 can connect with the cabinet body 10 stably. In detail, at least two of the second connecting elements 311 are perpendicularly arranged.

The first sliding rail 31 further defines at least one first through hole 3101, the second connecting element 311 is configured to at least partially cover the first through hole 3101. The second connecting element 311 can extend from a periphery or a wall of the first through hole 3101, and at least partially cover the first through hole 3101. The first through hole 3101 is used to facilitate to connect the second connecting element 311 with the cabinet body 10. A quantity of the first through hole 3101 is equal to that of the second connecting element 311.

The second connecting element 311 is a protrusion, a clamp, an elastic sheet, a rigid sheet, a through hole, or a groove. At least one of the second connecting elements 311 extends obliquely from the periphery or the wall of the first through hole 3101 towards a top end of the cabinet body 10. When the second connecting element 311 is the protrusion, the clamp, the elastic sheet, or the rigid sheet, the free end of the second connecting element 311 is smaller than an end of the second connecting element 311 away from the free end, so the second connecting element 311 can be connected with the cabinet body 10 easily. At least another one of the second connecting elements 311 extends obliquely from the periphery or the wall of the first through hole 3101 along a length direction of the first sliding rail 31. When the second connecting element 311 is an elastic sheet, or a rigid sheet, an angle defined between the elastic sheet or the rigid sheet and the first sliding rail 31 has a range of 30~60°. When the second connecting element 311 is a clamp, the clamp includes a connecting portion connected with the periphery or the wall of the first through hole 3101, a clamping portion connected with the connecting portion, and a guiding portion connected with an end of the clamping portion away from the connecting portion, the connecting portion extends obliquely from the periphery or the wall of the first through hole 3101, the clamping portion is substantially parallel with the first sliding rail 31, and the guiding portion extends upwards and obliquely from the end of the clamping portion away from the connecting portion. The connecting portion may be elastic, so the clamp can clamp an object stably. The clamping portion or the guiding portion can al so be elastic.

The first sliding rail 31 further includes at least one third connecting element 312 detachably connected with the cabinet body 10. The third connecting element 312 can be spaced apart from the second connecting element 311. The third connecting element 312 can be parallel with the second connecting element 311. The third connecting element 312 can be different from the second connecting element 311 in shape. The third connecting element 312 and the second connecting element 311 can be arranged on a same side of the first sliding rail 31. The third connecting element 312 is a protrusion, a clamp, an elastic sheet, a rigid sheet, a through hole, or a groove. When the third connecting element 312 is the protrusion, the clamp, the rigid sheet, or the elastic sheet, free ends of the third connecting element 312 and the second connecting element 311 can extend in different directions. Preferably, the free ends of the third connecting element 312 and the second connecting element 311 can extend in opposite directions. The third connecting element 312 may have the same structure as the second connecting element 311, or have different structure from the second connecting element 311. A diameter of the second connecting element 311 may be greater than that of the third connecting element 312.

The first sliding rail 31 further defines at least one third through hole 3102, the at least one third connecting element 312 is configured to at least partially cover the third through hole 3102. The third connecting element 312 can extend from a periphery or a wall of the third through hole 3102, and at least partially cover the third through hole 3102. The third through hole 3102 is used to facilitate to connect the third connecting element 312 with the cabinet body 10. A quantity of the third through hole 3102 is equal to that of the third connecting element 312.

A quantity of the at least one first connecting element 321 is more than one, and the first connecting elements 321 are spaced apart from each other. At least two of the first connecting elements 321 are arranged towards different directions, so the movable member 32 can connect with the drawer 20 stably. In detail, at least two of the first connecting elements 321 are perpendicularly arranged.

The movable member 32 further defines at least one second through hole 3201, the at least one first connecting element 321 is configured to at least partially cover the second through hole 3201. The first connecting element 321 can extend from a periphery or a wall of the second through hole 3201, and at least partially cover the second through hole 3201. The second through hole 3201 is used to facilitate to connect the first connecting element 321 with the drawer 20. A quantity of the second through hole 3201 is equal to that of the first connecting element 321.

The first connecting element 321 is a protrusion, a clamp, an elastic sheet, a rigid sheet, a through hole, or a groove. At least one of the first connecting element 321 extends obliquely from the periphery or the wall of the second through hole 3201 towards a top end of the cabinet body 10. At least another one of the first connecting elements 321 extends obliquely from the periphery or the wall of the second through hole 3201 along a length direction of the movable member 32. The first connecting element 321 may have the same structure as the second connecting element 311, or have different structure from the second connecting element 311. The first connecting element 321 is a clamp which includes a connecting portion 3211 obliquely extended from a periphery or a wall of the through hole 3201, a clamping portion 3212 connected with the connecting portion 3211, and a guiding portion 3213 connected with an end of the clamping portion 3212 away from the connecting portion 3211. The clamping portion 3212 is substantially parallel with the movable member 32, and the guiding portion 3213 extends upwards and obliquely from the clamping portion 3211. At lease one of the connecting portion 3211, clamping portion 3212 or the guiding portion 3213 is elastic, so the first connecting element 321 can clamp an object stably. A size of the guiding portion 3213 is smaller than that of the connecting portion 3211.

The movable member 32 further includes at least one fourth connecting element 322 detachably connected with the drawer 20. The fourth connecting element 322 can be parallel with the first connecting element 321. The fourth connecting element 322 can be spaced apart from the first connecting element 321. The fourth connecting element 322 can be different from the first connecting element 321 in shape. The fourth connecting element 322 and the first connecting element 321 are arranged on a same side of the movable member 32. The fourth connecting element 322 is a protrusion, a clamp, an elastic sheet, a rigid sheet, a through hole, or a groove. When the fourth connecting element 322 is the protrusion, the clamp, the rigid sheet, or the elastic sheet, free ends of the fourth connecting element 322 and the first connecting element 321 can extend in different directions. Preferably, the free ends of the fourth connecting element 322 and the first connecting element 321 can extend in opposite directions. The fourth connecting element 322 may have the same structure as the third connecting element 312, or have different structure from the third connecting element 312. When the fourth connecting element 322 is an elastic sheet, or a rigid sheet, an angle defined between the elastic sheet or the rigid sheet and the second sliding rail 32 has a range of 30~60°. A diameter of the fourth connecting element 322 may be greater than that of the first connecting element 321.

The movable member 32 further defines at least one fourth through hole 3202, the at least one fourth connecting element 322 is configured to at least partially cover the fourth through hole 3202. The fourth connecting element 322 can extend from a periphery or a wall of the fourth through hole 3202, and at least partially cover the fourth through hole 3202. The fourth through hole 3202 is used to facilitate to connect the fourth connecting element 322 with the drawer 20. A quantity of the fourth through hole 3202 is equal to that of the fourth connecting element 322.

The sliding rail structure further includes a second sliding rail 33 connected with the first sliding rail 31, the movable member 32 is slidably connected with the first sliding rail 31 by the second sliding rail 33. The second sliding rail 33 can be slidably connected with the first sliding rail 31 or fixedly connected with the first sliding rail 31. The first sliding rail 31 defines a first sliding groove 310, the second sliding rail 33 can be slidably received in the first sliding groove 310 or fixedly received in the first sliding groove 310.

The first sliding rail 31 further includes two opposite support plates 313 arranged on an end of the first sliding rail 31, and a first blocking member 314 arranged on another end of the first sliding rail 31. The two support plates 313 are configured to support the second sliding rail 33. The support plate 313 is extended perpendicularly from the first sliding rail 31. The first blocking member 314 is configured to prevent the second sliding rail 33 and/or the movable member 32 from sliding out of the first sliding rail 31. The first sliding rail 31 defines a first notch 3104, the first blocking member 314 is received in the first notch 3104 and partially extended out of the first notch 3104.

The second sliding rail 33 includes a bottom wall 331, and two opposite second side walls 332 connected with the bottom wall 331. The two support plates 313 are configured to support the second side walls 332. A portion of the bottom wall 331 is protruded away from the first sliding rail 31 to form a sub sliding rail 333, the movable member 32 is slidably connected with the sub sliding rail 333. The bottom wall 331, the second side walls 332, the sub sliding rail 333 cooperatively defines a sliding groove 334, the movable member 32 is slidably received in the sliding groove 334, and the movable member 32 can be limited by the first blocking member 314.

An end of the movable member 32 defines a second notch 3204, the second notch 3204 is matched with the first notch 3104 in shape, so the movable member 32 can move along the first sliding rail 31 by the second sliding rail 33 until an inner wall of the second notch 3204 is blocked by the first blocking member 314. Another end of the movable member 32 away from the first sliding rail 31 is protruded with a second blocking member 323, the second blocking member 323 extends perpendicularly from the movable member 32, the second block member 323 is configured to prevent the second sliding rail 33 from moving out of the movable member 32.

Please referring to FIGS. 1 to 18, the present disclosure further provides a cabinet 100, which includes a cabinet body 10, at least one drawer 20 connected with the cabinet body 10 in a drawable manner, and at least one sliding rail structure 30. The drawer 20 is slidably connected with the cabinet body 10 by the sliding rail structure 30. The cabinet body 10 includes at least one second mounting member 1311 detachably connected with the second connecting element 311. The drawer 20 includes at least one first mounting member 211 detachably connected with the first connecting element 321.

As the cabinet 100 adopts all the technical proposals of the above exemplary embodiments, the cabinet 100 at least has all of the beneficial effects of the technical proposals of the above exemplary embodiments, no need to repeat again.

The cabinet 100 includes a plurality of drawers 20 and a plurality of sliding rail structures 30. Each drawer 20 includes two third side walls 21, each third side wall 21 is connected one corresponding sliding rail structure 30. A quantity of the drawer 20 is matched with that of the sliding rail structures 30. Each third side wall 21 includes the at least one first mounting member 211. The first mounting member 211 is a protrusion, a clamp, an elastic sheet, a rigid sheet, a through hole, or a groove, and the first mounting member 211 is matched with the first connecting element 321. In an example, the first mounting member 211 is a protrusion, a clamp, or an elastic sheet, and the first connecting element 321 can be a through hole, or a groove. In another example, the first mounting member 211 is a through hole, or a groove, and the first connecting element 321 can be a protrusion, a clamp, or an elastic sheet. The first mounting member 211 is matched with the first connecting element 321, when the first mounting member 211 is a through hole, a lower end of the first mounting member 211 is larger than a top end of the first mounting member 211, so it is convenient to mount the first connecting element 321 in the first mounting member 211 upwards. The first mounting member 211 may have the same structure as the second mounting member 1311, or the first mounting member 211 is different from the second mounting member 1311 in shape.

The cabinet body 10 includes two opposite first side walls 11 and two first mounting assemblies 13 respectively arranged on the first side walls 11, the first mounting assembly 13 includes the at least one second mounting member 1311. The cabinet body 10 further include a bottom wall (not labeled) and a top wall (not labeled), the bottom wall and the top wall are connected with the first side walls 11 to defines a receiving space 12. The drawer 20 is received in the receiving space 12.

The first mounting assembly 13 further includes a first mounting plate 131 which includes the at least one second mounting member 1311, and at least one first connecting plate 132 connected with the first side wall 11 and the first mounting plate 131, the first mounting plate 131, the first connecting plate 132, and the first side wall 11 cooperatively define a first receiving space 133, the second connecting element 311 is configured to pass through the second mounting member 1311 and partially extend in the first receiving space 133. The first mounting assembly 13 further includes a plate 1314 connected with the first side wall 11 and the first connecting plate 132 to stably connect the first mounting assembly 13 with the first side wall 11.

The second mounting member 1311 is a protrusion, a clamp, an elastic sheet, a rigid sheet, a through hole, or a groove, and the second mounting member 1311 is matched with the second connecting element 311. In an example, the second connecting elements 311 is a protrusion, a clamp, or an elastic sheet, and the second mounting member 1311 can be a through hole, or a groove. In another example, the second connecting elements 311 is a through hole, or a groove, and the second mounting member 1311 can be a protrusion, a clamp, or an elastic sheet. When the second mounting member 1311 is an elastic sheet, or a rigid sheet, an angle defined between the elastic sheet or the rigid sheet and the first mounting plate 131 has a range of 30~60°. When the second mounting member 1311 is a clamp, the clamp includes a connecting portion connected with the first mounting plate 131, a clamping portion connected with the connecting portion, and a guiding portion connected with an end of the clamping portion away from the connecting portion. The connecting portion extends obliquely from the first mounting plate 131, the clamping portion is substantially parallel with the first mounting plate 131, and the guiding portion extends obliquely from the end of the clamping portion away from the connecting portion. The connecting portion may be elastic, so the clamp can clamp an object stably. The clamping portion or the guiding portion may also be elastic.

The third connecting element 312 is arranged adjacent to one second connecting element 311, and free ends of the third connecting element 312 and the second connecting element 311 extend towards opposite directions. When the second mounting member 1311 is a groove or a through hole, the second connecting element 311 and the third connecting element 312 are both received in the second mounting member 1311. As free ends of the third connecting element 312 and the second connecting element 311 extend towards opposite directions, the third connecting element 312 and the second connecting element 311 can be connected with the second mounting member 1311 from opposite directions, so the third connecting element 312 and the second connecting element 311 can stably connected with the second mounting member 1311.

The first mounting plate 131 further defines at least one via hole 1312 extended in a length direction of the first mounting plate 131. The cabinet body 10 further includes a first locking member 15 movably connected with the first mounting plate 131, in detail, the first locking member 15 is movably received in the first receiving space 133. The first locking member 15 includes a locking plate 151 protruded with at least one locking rod 1511 and movably received in the via hole 1312, and two connecting portions 152 connected with the locking plate 151 and the first side wall 11. The drawer 20 further includes a blocking member 214 which includes a connecting portion connected with an outer surface of the drawer 20, and a blocking portion perpendicularly connected with the connecting portion. When the locking rod 1511 is blocked by the blocking portion of the blocking member 214, the drawer 20 cannot be pulled out of the cabinet body 10, and the locking rod 1511 move in the via hole 1312 and separate from the blocking portion of the blocking member 214, the drawer 20 can be pulled out of the cabinet body 10. It should be understood that, the cabinet 100 further includes a lock (not labeled) connected with the first locking member 15, and user can handle the lock to pull the drawer 20 out of the cabinet body 10, in detail user can handle the lock to drive the first locking member 15 to move, further to drive the locking rod 1511 to move in the via hole 1312.

When the second mounting member 1311 is a through hole, the first locking member 15 further defines a third notch 1512 facing the second mounting member 1311. The locking plate 151, and the connecting portions 152 cooperatively define a space (not labeled) communicated with the third notch 1512, the space and third notch 1512 are used to facilitate to connect the second connecting element 311 with the second mounting member 1311. The third notch 1512 passes through a portion of the locking plate 151 and portions of the connecting portions 152. The first locking member 15 and the first mounting assembly 13 are received in a fourth notch 111 of the first side wall 11.

The second mounting member 1311 further defines a fifth notch 1313, a connector (not labeled) can received in the fifth notch 1313 to connect the second mounting member 1311 with the first side wall 11.

The cabinet body 10 further includes a second mounting assembly 14 arranged on the first side wall 11, the second mounting assembly 14 includes at least one third mounting member 1411, a quantity of the second connecting element 311 is more than one, at least one of the second connecting elements 311 is detachably connected with the third mounting member 1411.

The second mounting assembly 14 includes a second mounting plate 141 which includes the at least one third mounting member 1411, and at least one second connecting plate 142 connected with the first side wall 11 and the second mounting plate 141, the second mounting plate 141, the second connecting plate 142, and the first side wall 11 cooperatively define a second receiving space 143, at least one of the second connecting elements 311 is configured to pass through the third mounting member 1411 and partially extend in the second receiving space 143. The second mounting plate 141 has a groove 144 defined along a length direction of the second mounting plate 141, the groove 144 includes a bottom wall (not labeled) and two fourth side walls 1441 connected with the bottom wall and the second mounting plate 141. When the third mounting member 1411 is a groove or a through hole, the third mounting member 1411 passes through a portion of the second mounting plate 141 and a portion of the fourth side wall 1441, so the second connecting element 311 can easily pass through the third mounting member 1441.

The cabinet body 10 further includes a second locking member 16 movably connected with the second mounting plate 141, a first limiting member 17 connected with the second locking member 16, and a second limiting member 22 connected with the outer surface of the drawer 20. In detail, the second locking member 16 is movably received in the groove 144. The second locking member 16 includes at least one first locking rod 161 and at least one second locking rod 162. The first limiting member 17 can be fixed to the first side wall 11 of the cabinet body 10. The first limiting member 17 is substantially T shaped, and includes a first receiving hole 171, a second receiving hole 173, a third receiving hole 175, a first channel 172 configured to communicate the first receiving hole 171 with the second receiving hole 173, a second channel 174 configured to communicate the second receiving hole 173 with the third receiving hole 175, a receiving groove 176, and at least one adjusting hole 177 arranged parallel to the first receiving hole 171 and defined in a bottom wall of the receiving groove 176. Side walls of the first channel 172 and the second channel 174 are flexible, so the second locking member 162 can pass through the first channel 172 and the second channel 174. The second locking member 16 is movably received in the receiving groove 176. A width of the receiving groove 176 is greater than an aperture of the first receiving groove 171. The adjusting hole 177 is configured to increase elastic deformation strengths of the side walls of the first channel 172 and the second channel 174. A length of the adjusting hole 177 is longer than a sum of a length of the first receiving hole 171, a length of the second receiving hole 173 and a length of the third receiving hole 175. The second limiting member 22 includes a support plate 221 connected with the outer surface of the drawer 20, a first triangular protrusion 222 arranged on a lower end of the support plate 221, and a second triangular protrusion 223 arranged on a top end of the support plate 221.

When the drawers 20 are locked in the cabinet body 10 by the lock (the lock can push the first locking rods 161 to move upwards or downwards), the first locking rods 161 are stopped by side surfaces 2231 of the second triangular protrusions 223, and the second locking rods 162 are received in the first receiving holes 171 and blocked by side walls of the first channels 172. When user opens the lock, and have not pulled the drawers 20 from the cabinet body 10, the lock can drive the first locking rods 161 and the second locking rod 162 to move downwards until the first locking rods 161 are located on flat surfaces 2221 of the first triangular protrusions 222, and the second locking rods 162 are received in the second receiving holes 173 or the third receiving holes 175. There is no need to describe the detail structure of the lock as the lock is common in the market.

When user pull a first drawer 20 out of the cabinet body 10, the first locking rod 161 of the first drawer 20 moves upwards along a first inclined surface 2222 to drive the first mounting plate 131 to move upwards, so the second locking rod 162 corresponding to a second drawer 20 is moved upwards and stopped by the side surface 2231 of the second triangular protrusion 223 corresponding to the second drawer 20, so the second drawer 20 cannot be opened. In this way, only one drawer 20 can be drawn out of the cabinet body 10 at a time. When the first locking rod 161 of the first drawer 20 moves upwards along the first inclined surface 2222, the second locking rod 162 also move upwards to the first receiving hole 171, the second locking rod 162 is stopped by side walls of the first channel 172, even the first locking rod 161 of the first drawer 20 moves downwards along a second inclined surface 2223, the side walls of the first channel 172 can also prevent the first mounting plate 131 from moving downwards.

The third mounting member 1411 is a protrusion, a clamp, an elastic sheet, a rigid sheet, a through hole, or a groove, and the third mounting member 1411 is matched with the second connecting element 311. In an example, the third mounting member 1411 is a protrusion, a clamp, or an elastic sheet, and the second connecting element 311 can be a through hole, or a groove. In another example, the third mounting member 1411 is a through hole, or a groove, and the second connecting element 311 can be a protrusion, a clamp, or an elastic sheet.

Each third side wall 21 includes the at least one fourth mounting member 212, the fourth mounting member 212 is a protrusion, a clamp, an elastic sheet, a rigid sheet, a through hole, or a groove, and the fourth mounting member 212 is matched with the fourth connecting element 322. In an example, the fourth mounting member 212 is a protrusion, a clamp, or an elastic sheet, and the fourth connecting element 322 can be a through hole, or a groove. In another example, the fourth mounting member 212 is a through hole, or a groove, and the fourth connecting element 322 can be a protrusion, a clamp, or an elastic sheet. The fourth mounting member 212 and the first mounting member 211 can extend in opposite directions, and the first connecting element 321 and the fourth connecting element 322 can extend in opposite directions, so the second sliding rail 32 can be connected with the drawer 20 stably.

The present disclosure further provides a method for for mounting a drawer 20 on a furniture by at least one sliding rail structure 30, The furniture may be a cabinet, a desk, a closet, a cupboard, a TV bench, and the like. The furniture of the present disclosure may be illustrated by a cabinet 100. The method includes the following steps: connecting the first connecting element 321 with the first mounting member 211, to connect the movable member 32 with the drawer 20; and connecting the second connecting element 311 with the second mounting member 1311, to connect the first sliding rail 31 with the cabinet body 10.

The second connecting element 311 and the third connecting element 312 can be connected with the second mounting member 1311 from different directions. As free ends of the second connecting element 311 and the third connecting element 312 extend in opposite directions, the second connecting element 311 and the third connecting element 312 can be connected with the second mounting member 1311 from two opposite vertical directions. In an embodiment, the second mounting member 1311 is a through hole, the second connecting element 311 and the third connecting element 312 is a clamp, an elastic sheet, a rigid sheet, the second connecting element 311 and the third connecting element 312 can be inserted in the second mounting member 1311, the second connecting element 311 can be connected with or clamped with an upper periphery of the second mounting member 1311, the third connecting element 312 can be connected with or clamped with a lower periphery of the second mounting 1311, to prevent the first sliding rail 31 from shaking in an up-down direction. In this way, the method includes: placing the second connecting element 311 in the second mounting member 1311, moving the second connecting element 311 upwards to enable the third connecting element 312 to insert in the second mounting member 1311, stopping moving the second connecting element 311 upwards and the second connecting element 311 moving downwards until the third connecting element 312 is connected with or clamped with the lower periphery of the second mounting member 1311.

It should be understood that, the second mounting member 1311 is a clamp, an elastic sheet, a rigid sheet, the second connecting element 311 and the third connecting element 312 is a through hole, the second mounting members 1311 can be connected with the second connecting element 311 and the third connecting element 312, respectively.

In another embodiment, the second mounting member 1311 can be a groove or a through hole, the second connecting element 311 and the third connecting element 312 can also be a protrusion, the protrusion can be received in the groove or the through hole, to connect the first sliding rail 31 with the cabinet body 10. In this way, the method includes: inserting the second connecting element 311 and the third connecting element 312 in the second mounting members 1311 respectively.

In another embodiment, the second connecting element 311 and the third connecting element 312 can also be a groove or a through hole, the second mounting members 1311 can be protrusions. In this way, the method includes: inserting the second mounting members 1311 in the second connecting element 311 and the third connecting element 312 respectively.

In one embodiment, another second connecting element 311 can extended along the length direction of the first sliding rail 31, the third mounting member 1411 is a through hole, the second connecting element 311 is a clamp, an elastic sheet, a rigid sheet. In this way, the method includes: inserting the another second connecting element 311 in the third mounting member 1411, pushing the drawer 20 to move outwards until the another second connecting element 311 connected with or clamped with a side periphery of the third mounting member 1411 away from the first mounting assembly 13. The another second connecting element 311 can prevent the first sliding rail 31 from shaking in a left-right direction.

In one embodiment, free end of the first connecting element 321 and the fourth connecting element 322 extend towards opposite directions. The second connecting element 311 and the fourth connecting element 322 can be a clamp, an elastic sheet, or a rigid sheet, the first mounting member 211 and the fourth mounting member 212 can be a through hole. In this way, the method includes: inserting the first connecting element 321 in the first mounting member 211, moving the first connecting element 321 upwards to enable the inserting of the fourth connecting member 212 in the fourth mounting member 212, stopping moving the first connecting element 321 upwards and the first connecting element 321 moving downwards until the fourth mounting member 212 is connected with or clamped with the fourth mounting member 212. The first connecting element 321 can be clamped with or connected with an upper periphery of the first mounting member 211, the fourth connecting element 322 can be clamped with or connected with a lower periphery of the fourth mounting member 212. The first connecting element 321 and the fourth connecting element 322 can prevent the movable member 32 from shaking in the up-down direction.

It should be understood that, the first connecting element 321 and the fourth connecting element 322 can be a through hole, the first mounting member 211 and the fourth mounting member 212 can be a clamp, an elastic sheet, or a rigid sheet.

It should be understood that, the first connecting element 321 and the fourth connecting element 322 can be a protrusion, the first mounting member 211 and the fourth mounting member 212 can be a groove or a through hole. In this way, the method includes: inserting the first connecting element 321 and the fourth connecting element 322 in the first mounting member 211 and the fourth mounting member 212 respectively.

It should be understood that, the first connecting element 321 and the fourth connecting element 322 can be a groove or a through hole, the first mounting member 211 and the fourth mounting member 212 can be a protrusion. In this way, the method includes: inserting the first mounting member 211 and the fourth mounting member 212 in the first connecting element 321 and the fourth connecting element 322 respectively.

The above description is merely some embodiments. It should be noted that for one with ordinary skills in the art, improvements can be made without departing from the concept of the present disclosure, but these improvements shall fall into the protection scope of the present disclosure.

What is claimed is:

1. A mounting structure of a drawer, configured to mount the drawer on a furniture by at least one sliding rail structure, the sliding rail structure comprises a first sliding rail and a movable member, wherein the mounting structure comprises:

at least two first connecting elements, arranged on the movable member, the first connecting elements are detachably connected with the drawer; and at least two second connecting elements, arranged on the first sliding rail, the second connecting elements are detachably connected with a side wall of the furniture, the movable member is slidably connected with the first sliding rail to slidably connect the drawer with a body of the furniture, wherein the mounting structure further comprises at least two fourth connecting elements, the at least two fourth connecting elements and the at least two first connecting elements are arranged on a same side of the movable member, free ends of the at least two fourth connecting elements and the at least two first connecting elements extend along opposite directions, extending directions of the at least two fourth connecting elements and the at least two first connecting elements are substantially perpendicular to a moving direction of the movable member in the sliding rail structure, the drawer comprises at least two first mounting members matched with the at least two first connecting elements and at least two fourth mounting members matched with the at least two fourth connecting elements;

wherein one of the at least two first connecting elements and one of the at least two fourth connecting elements form one pair of drawer connecting elements, another one of the at least two first connecting elements and another one of the at least two fourth connecting elements form another one pair of drawer connecting elements; the one pair of drawer connecting elements is disposed adjacent to each other at an end of the movable member along the moving direction of the movable member, the another one pair of drawer connecting elements is disposed adjacent to each other at the other end of the movable member along the moving direction of the movable member;

the mounting structure comprises at least one third connecting member, arranged on the first sliding rail: the third connecting element is detachably connected with the side wall of the furniture; a free end of the third connecting element and a free end of one of the at least two second connecting elements are extending in different directions and are extending perpendicular to the moving direction of the movable member; and a free end of another one of the at least two second connecting elements is extending along the moving direction of the movable member; and a connection manner in which the drawer is connected to the movable member by the at least two first connecting elements and at least two fourth mounting members is different from a connection manner in which the sliding rail is connected to the side wall of the furniture by the at least two second connecting elements and the at least one third connecting element.

2. The mounting structure of a drawer according to claim 1, wherein at least one first through hole is defined in the movable member, one of the at least two first connecting elements is configured to at least partially cover the at least one first through hole, one of the at least two first connecting elements comprises a connecting portion extended from a periphery or a wall of the first through hole, and a guiding portion connected with the connecting portion and a clamping portion connected between the connecting portion and the guiding portion, the guiding portion obliquely extends upwards from the clamping portion.

3. The mounting structure of a drawer according to claim 1, wherein the mounting structure further comprises at least one second through hole defined in the first sliding rail, the at least one third connecting element is configured to at least partially cover the second through hole.

4. The mounting structure of a drawer according to claim 1, wherein the mounting structure further comprises at least one third through hole defined in the movable member, one of the at least two fourth connecting elements is configured to at least partially cover the third through hole.

5. The mounting structure of a drawer according to claim 1, wherein the mounting structure of the drawer comprises a first mounting assembly, and the first mounting assembly further comprises: a first mounting plate, comprising at least one second mounting member; and at least one first connecting plate, connected with the side wall and the first mounting plate, the first mounting plate, the first connecting plate, and the side wall cooperatively define a first receiving space, one of the at least two second connecting elements is configured to pass through the at least one second mounting member and partially extend in the first receiving space.

6. The mounting structure of a drawer according to claim 1, wherein the mounting structure of the drawer comprises a second mounting assembly, and the second mounting assembly comprises: a second mounting plate, comprising at least one third mounting member; and at least one second connecting plate, connected with the side wall and the second mounting plate, the second mounting plate, the second connecting plate, and the side wall cooperatively define a second receiving space, one of the at least two second connecting elements is configured to pass through the third mounting member and partially extend in the second receiving space.

7. The mounting structure of a drawer according to claim 6, wherein the third mounting member is a protrusion, a clamp, an elastic sheet, a rigid sheet, a through hole, or a groove, and the third mounting member is matched with the one of the at least two second connecting elements.

8. The mounting structure of a drawer according to claim 1, further comprising:

a second sliding rail, slidably connected with the first sliding rail, the movable member is also slidably connected with the second sliding rail; and two opposite support plates, arranged on the first sliding rail and configured to support the second sliding rail.

9. The mounting structure of a drawer according to claim 1, wherein the first sliding rail comprises a first notch and first blocking member, the first blocking member is received in the first notch and extended out of the first notch, the first blocking member is configured to prevent the movable member from sliding out of the first sliding rail.

10. The mounting structure of a drawer according to claim 9, wherein the mounting structure of the drawer further comprises a second sliding rail, the movable member defines a second notch corresponded with the first notch, the movable member is capable of sliding on the second sliding rail until the first block member is stopped by a wall of the second notch.

11. The mounting structure of a drawer according to claim 1, wherein the mounting structure of the drawer further comprises a second sliding rail, the movable member further comprises a second blocking member configured to prevent the second sliding rail from sliding out of the movable member.

12. The mounting structure of a drawer according to claim 5, wherein the first mounting plate further defines at least one via hole extended in a length direction of the first mounting plate;

the mounting structure of the drawer further comprises a first locking member movably received in the first receiving space of the first mounting assembly, the first locking member comprises a first locking rod movably received in the via hole; and the drawer comprises a third blocking member, the third blocking member is configured to block the first locking rod to prevent the drawer from sliding out of the furniture.

13. The mounting structure of a drawer according to The mounting structure of a drawer according to claim 5, wherein the mounting structure of the drawer further comprises a first locking member movably received in the first receiving space, the first locking member further defines a third notch, the second mounting member is a through hole communicated with the third notch, the third notch is configured to facilitate a connection between the one of the at least two second connecting elements and the second mounting member.

14. The mounting structure of a drawer according to claim 6, wherein the furniture further comprises a second locking member movably connected with the second mounting plate, a first limiting member connected with the second locking member, and a second limiting member connected with the drawer, the second locking member comprises at least one second locking rod and at least one third locking rod, the first limiting member defines a first receiving hole, a second receiving hole, and a channel configured to communicate the first receiving hole with the second receiving hole, the second locking member comprises a support plate connected with the drawer, a first triangular protrusion arranged on a lower end of the support plate, and a second triangular protrusion arranged on a top end of the support plate, when the drawer is locked in the furniture, the second locking rod is stopped by the second triangular protrusion and the third locking rod is received in the first receiving hole and blocked by a side wall of the first channel; and when the drawer is unlocked in the furniture, the second locking rod is located on the first triangular protrusion and the third locking rod is received in the second receiving hole.

15. A method for mounting a drawer to a furniture by at least one sliding rail structure, the drawer is provided with at least two first mounting members, a side wall of the furniture is provided with at least two second mounting members, the sliding rail structure comprises a first sliding rail and a movable member slidably connected with the first sliding rail, the movable member is provided with at least two first connecting elements, the first sliding rail is provided with at least two second connecting elements, the movable member further comprises at least two fourth connecting elements, the at least two fourth connecting elements and the at least two first connecting elements are arranged on a same side of the movable member, free ends of the at least two fourth connecting elements and the at least two first connecting elements extend along opposite directions, extending directions of the at least two fourth connecting elements and the at least two first connecting elements are substantially perpendicular to a moving direction of the movable member in the sliding rail structure, the at least two first mounting members matched with the at least two first connecting elements and at least two fourth mounting members matched with the at least two fourth connecting elements, the method comprises the following steps:

connecting the at least two first connecting elements with the at least two first mounting members, and connecting the at least two fourth connecting elements with the at least two fourth mounting members, thereby connecting the movable member with the drawer;

connecting the at least two second connecting elements with the at least two second mounting members, to connect the first sliding rail with a body of the furniture; and inserting the movable member with the drawer into the first sliding rail with the body of the furniture, thereby mounting the drawer to the furniture;

wherein one of the at least two first connecting elements and one of the at least two fourth connecting elements form one pair of drawer connecting elements, another one of the at least two first connecting elements and another one of the at least two fourth connecting elements form another one pair of drawer connecting elements; the one pair of drawer connecting elements is disposed adjacent to each other at an end of the movable member along the moving direction of the movable member, the another one pair of drawer connecting elements is disposed adjacent to each other at the other end of the movable member along the moving direction of the movable member;

the mounting structure comprises at least one third connecting member, arranged on the first sliding rail: the third connecting element is detachably connected with the side wall of the furniture; a free end of the third connecting element and a free end of one of the at least two second connecting elements are extending in different directions and are extending perpendicular to the moving direction of the movable member; and a free end of another one of the at least two second connecting elements is extending along the moving direction of the movable member; and a connection manner in which the drawer is connected to the movable member by the at least two first connecting elements and at least two fourth mounting members is different from a connection manner in which the sliding rail is connected to the side wall of the furniture by the at least two second connecting elements and the at least one third connecting element.

* * * * *